US008800062B1

(12) United States Patent
Kunian

(10) Patent No.: US 8,800,062 B1
(45) Date of Patent: Aug. 12, 2014

(54) MULTI-FUNCTION CLOTHING ACCESSORY DESIGNS FOR MARGE K DESIGNS

(76) Inventor: Marjorie I. Kunian, Boston, MA (US)

( * ) Notice: Subject to any disclaimer, the term of this patent is extended or adjusted under 35 U.S.C. 154(b) by 0 days.

(21) Appl. No.: 13/549,033

(22) Filed: Jul. 13, 2012

Related U.S. Application Data

(60) Provisional application No. 61/574,715, filed on Aug. 8, 2011.

(51) Int. Cl.
*A42B 5/00* (2006.01)

(52) U.S. Cl.
USPC ..... 2/207

(58) Field of Classification Search
USPC ..... 2/88, 89, 91, 92, 90, 174, 203, 206, 2/207, 208, 170; D2/500, 719
See application file for complete search history.

(56) References Cited

U.S. PATENT DOCUMENTS

| | | | | | |
|---|---|---|---|---|---|
| 1,042,351 | A | * | 10/1912 | Johnstone | 2/207 |
| 1,157,341 | A | | 10/1915 | Tallerday | |
| 1,285,917 | A | * | 11/1918 | Bradley et al. | 2/91 |
| 1,739,433 | A | * | 12/1929 | Young | 2/88 |
| 1,963,659 | A | * | 6/1934 | Gregory | 2/90 |
| 2,639,431 | A | * | 5/1953 | Spear | 2/88 |
| D170,340 | S | * | 9/1953 | Salny | D2/823 |
| 3,144,660 | A | * | 8/1964 | Portaro | 2/88 |
| 3,160,892 | A | | 12/1964 | Semons | 2/88 |
| 3,161,887 | A | * | 12/1964 | Silver | 2/88 |
| D226,744 | S | * | 4/1973 | Chaffin | D2/27 |
| 4,316,288 | A | * | 2/1982 | Henrickson | 2/88 |
| 4,559,647 | A | | 12/1985 | Smith et al. | 2/158 |
| 4,570,267 | A | * | 2/1986 | Appel | 2/91 |
| 4,706,304 | A | | 11/1987 | Jones | 2/91 |
| 4,870,707 | A | | 10/1989 | Hayes | 2/207 |
| 5,412,813 | A | * | 5/1995 | Hosley | 2/69 |
| 5,625,897 | A | * | 5/1997 | Park | 2/69 |
| 5,873,131 | A | * | 2/1999 | Sabin | 2/69 |
| D431,892 | S | * | 10/2000 | Maratta | D2/500 |
| 7,222,371 | B2 | * | 5/2007 | Houghton et al. | 2/88 |
| D578,278 | S | | 10/2008 | Song | D2/823 |
| D603,139 | S | * | 11/2009 | Martin | D2/823 |
| D618,883 | S | * | 7/2010 | Nelson | D2/719 |
| 2002/0073476 | A1 | * | 6/2002 | Jastrab et al. | 2/88 |
| 2006/0010569 | A1 | * | 1/2006 | Tawfik | 2/207 |
| 2006/0064795 | A1 | * | 3/2006 | Houghton et al. | 2/88 |
| 2008/0282444 | A1 | * | 11/2008 | Lin | 2/88 |
| 2010/0199399 | A1 | * | 8/2010 | Garza | 2/24 |
| 2010/0257658 | A1 | * | 10/2010 | Schwietz-Flauto | 2/207 |
| 2011/0126340 | A1 | * | 6/2011 | Wu | 2/88 |
| 2011/0138519 | A1 | * | 6/2011 | Serota | 2/207 |
| 2012/0137416 | A1 | * | 6/2012 | Taul | 2/461 |

FOREIGN PATENT DOCUMENTS

| | | | |
|---|---|---|---|
| CN | 201044614 | 4/2008 | A41D 13/08 |
| FR | 2828070 | 2/2003 | A41D 15/00 |

* cited by examiner

*Primary Examiner* — Alissa L Hoey
(74) *Attorney, Agent, or Firm* — Banner & Witcoff, Ltd

(57) ABSTRACT

A multi-function clothing accessory comprising an elongated generally oval-shaped panel having a peripheral ruffled edge, wherein tubular wristlets are formed inbound of the ends of the panel.

13 Claims, 9 Drawing Sheets

MULTI-FUNCTION CLOTHING ACCESSORY DESIGNS FOR MARGE K DESIGNS

CROSS REFERENCE TO RELATED APPLICATIONS

This application claims priority from U.S. Provisional Application Ser. No. 61/574,715, filed Aug. 8, 2011, the contents of which are incorporated herein in their entirety.

BACKGROUND OF THE INVENTION

This invention relates generally to clothing apparel, and in particular to a multi-function clothing accessory that can be adapted for use as a headscarf, a neck scarf or stole, a waist or hip belt, a sarong, a peplum or a peplum dress, a shawl and a jacket.

Various clothing accessories such as scarves, shawls, belts, sarongs, etc. exist. Consider, for example, scarves. Scarves usually are made from a single piece of textile having a square, rectangular or triangular configuration. Scarves generally are made from a wide assortment of materials and are worn in a wide variety of styles including as conventional neck scarves, head wraps, head bows, shoulder wraps and shawls or stoles. However, conventional scarves have limitations, and cannot be used, for example, as a jacket or belt.

It is therefore a principal object of the present invention to provide a clothing accessory item that can be used not only as a jacket, but also a headscarf, a neck scarf or stole, a belt, a sarong, a peplum or a peplum dress and a shawl.

SUMMARY OF THE INVENTION

In accordance with the present invention there is provided a multi-purpose clothing accessory comprising an elongated generally oval-shaped panel having a peripheral ruffled edge. Tubular wristlets are formed inboard at the ends of the panel.

In one aspect of the invention, the panel comprises a single piece of fabric.

In another aspect of the invention, the ruffle is stitched to the panel.

In another aspect of the invention, the ruffle is adhesively fixed to the panel.

In one aspect of the invention, the multi-purpose clothing accessory is used as a headscarf.

In another aspect of the invention, the multi-purpose clothing accessory is used as a neck scarf.

In still another aspect of the invention, the multi-purpose clothing accessory is used as a shawl or stole.

In still another aspect of the invention, the multi-purpose clothing accessory is used as a waist or hip belt.

In still another aspect of the invention, the multi-purpose clothing accessory is used as a sarong.

In still another aspect of the invention, the multi-purpose clothing accessory is used as a peplum or a peplum dress.

In still another aspect of the invention, multi-purpose clothing accessory is used as a jacket.

In still another aspect of the invention, the panel has a length-to-width aspect ratio of about 2.0 to about 4.0.

In still another aspect of the invention, the panel has a length-to-width aspect ratio of about 2.2 to about 3.6.

BRIEF DESCRIPTION OF THE DRAWINGS

Further features and advantages of the present invention will be seen from the following detailed description, taken in conjunction with the accompanying drawings, wherein.

DETAILED DESCRIPTION OF THE INVENTION

Figure 1A:
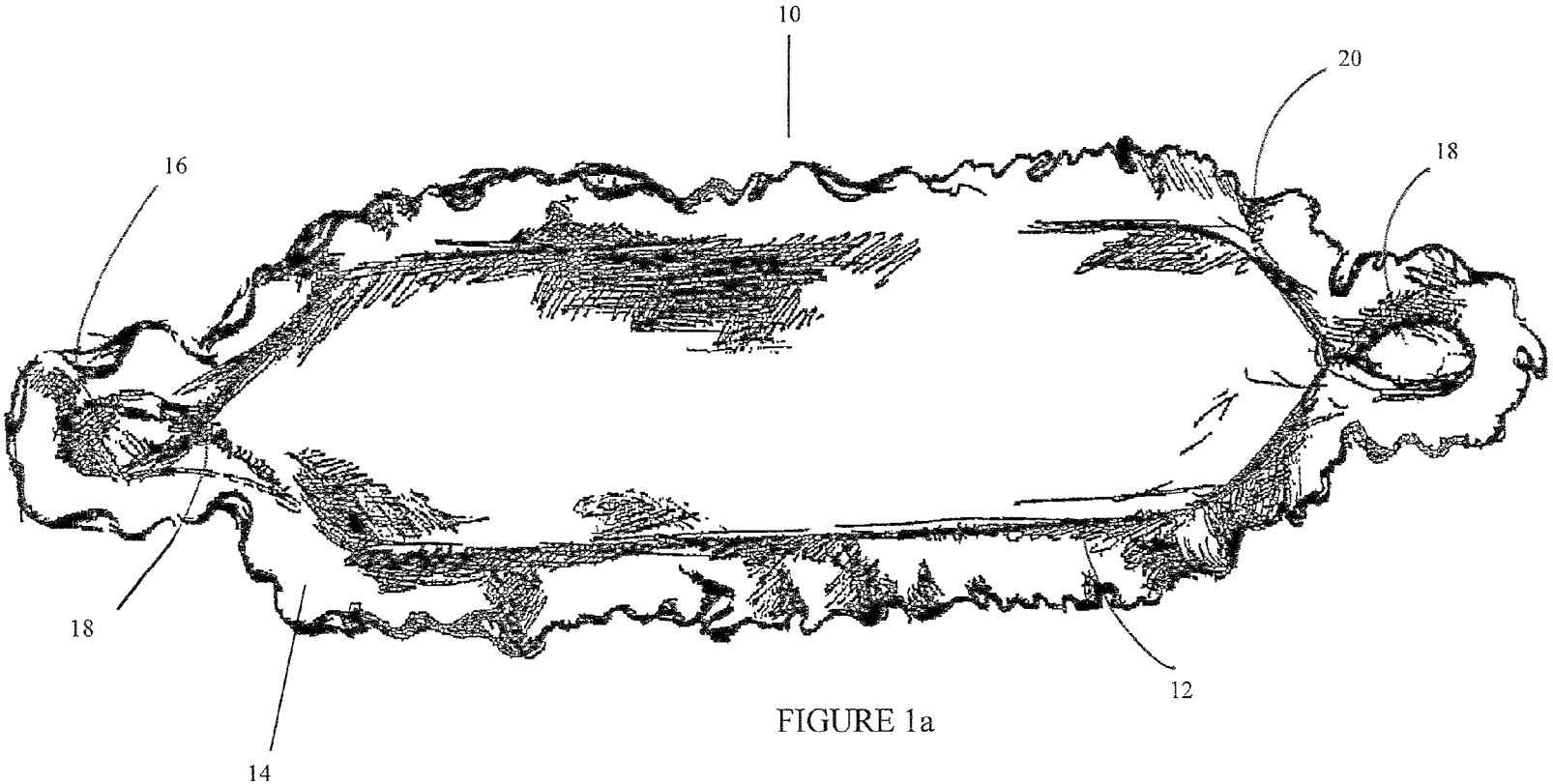
FIG. 1*a* is a top-plan view of a clothing accessory in accordance with my invention.
Figure 1B:
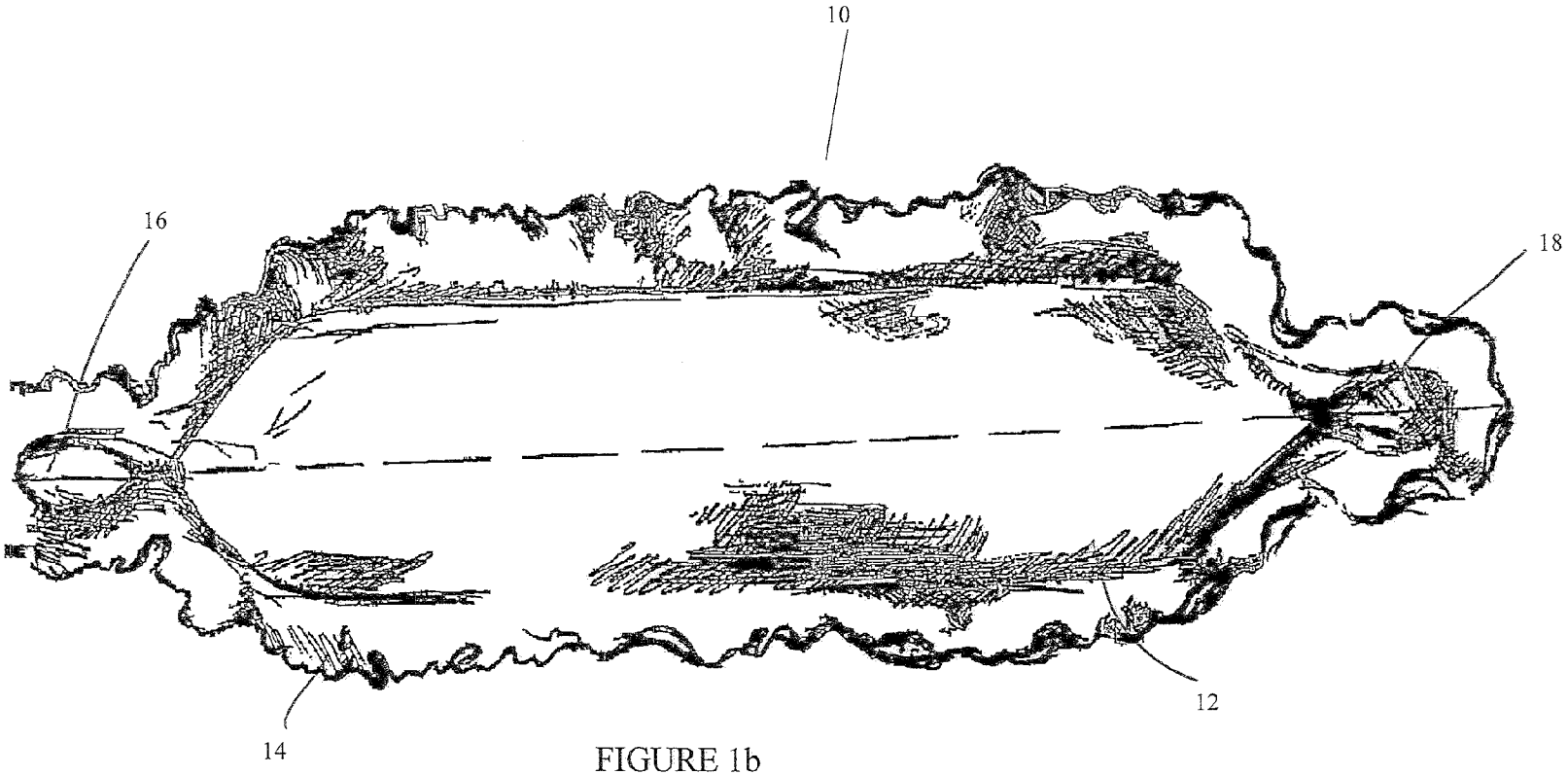
FIG. 1*b* is a bottom-plan view thereof.

FIGS. 1*a* and 1*b* show a clothing accessory 10 in accordance with the present invention. The clothing accessory comprises an elongated panel 12 having a generally oval shape. Panel 12 preferably comprises a single piece of fabric. A peripheral ruffle 14 is affixed to the panel 12. The opposite ends 16, 18 of the panel are gathered and stitched together inboard of the ends, i.e., at 18 and 20, respectively, to form stylized wristlets with the top longer than the bottom of the wrist or equal top and bottom or the arm length shorter or longer. The clothing accessory preferably is made in two sizes—a small size and a larger size for taller or wider individuals. On the larger size the widest part on panel 12 is approximately 1 to 2 inches wider. The clothing accessory also may be made in three or more sizes, or as a single, unisize product.

Preferably, panel 12 has a length-to-width aspect ratio of about 2.0 to 4.0, preferably about 2.2 to 3.6.

By way of example, but not limitation, details of construction of an accessory in accordance with the present invention are provided as follows.

In one embodiment the accessory 10 has an overall length of about 58 inches from end-to-end, and a maximum width, at its center, of approximately 16 inches. The ruffle 14 is approximately 4 inches wide and preferably is stitched to the panel 12. However, for some applications, ruffle 14 could be affixed to panel 12 using an adhesive.

The accessory 10 preferably is slightly tapered to form an oval shape. In one preferred embodiment, the panel 12 tapers from approximately 16 inches at its widest, and begins to taper at about one-quarter the way from the ends or about five inches from the ends, tapering easily down to 10 and then finally from 4 inches to 2 inches. The ends 16 and 18 of the accessory are gathered and fixed together, e.g. by sewing, snaps, buttons, etc., at approximately 4 to 8 inches from the ends to form wristlets.

In another embodiment, the panel 12 is about 28 inches across, and measures about 62 inches in length. As before, a ruffled piece is affixed to the periphery of the panel 12. The ruffle preferably is about 4 inches wide. However, the ruffles may be as little as about 1-2 inches wide, and may be 5 or 6 or more inches wide. In this latter embodiment, the wristlets may be formed at about 6-10 inches from the ends. On the larger size the ruffles preferably remain the same proportions as the small size and the same width.

Figure 2A:
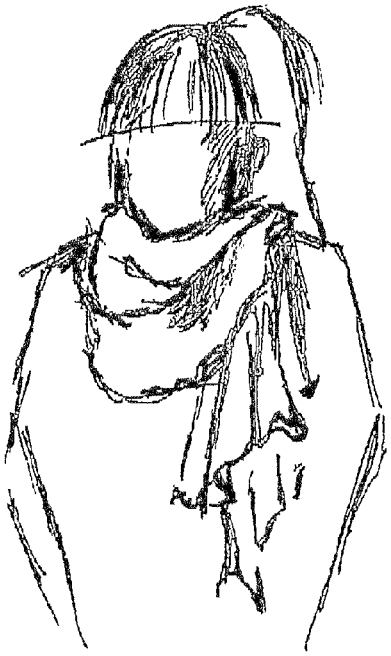
FIGS. 2*a*, 2*b* and 2*c* illustrate the use of the clothing accessory as a scarf.
Figure 2B:
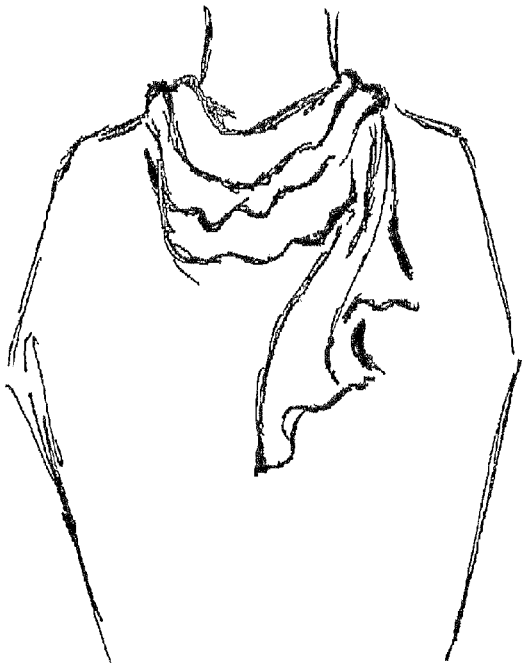
Figure 2C:
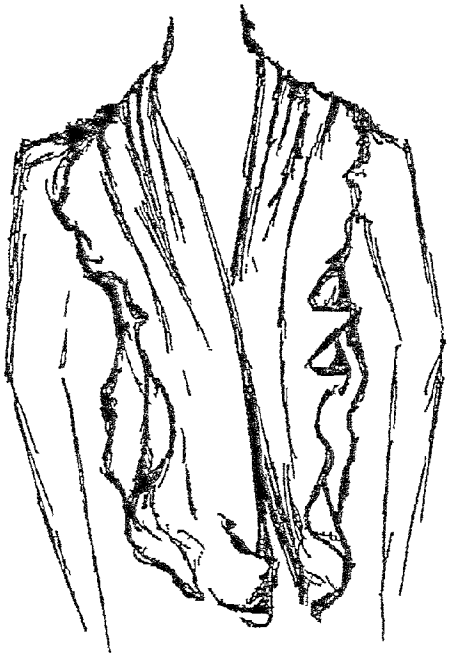

Further features and advantages of the invention will be seen by reference to FIGS. 2*a*, 2*b*, 2*c* and 3 to 10 which illustrate various uses of the invention as follows:

Folded in half with a straight edge at the front of the head, FIGS. 2*a*, 2*b* and 2*c* illustrate three ways to wear the accessory as a scarf.

Figure 3:
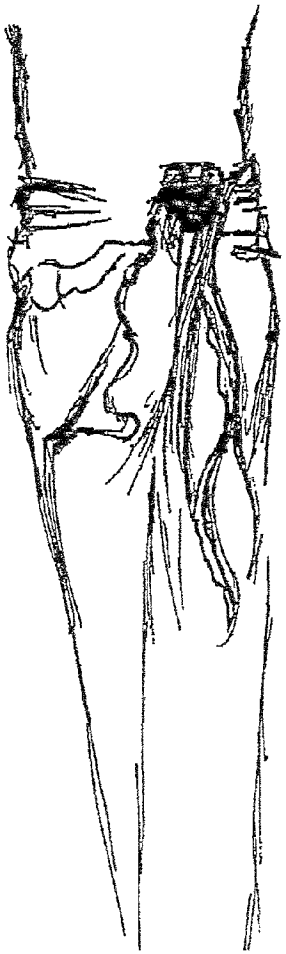
FIGS. 3 to 12 illustrate the use of the accessory as a belt around the waist, as a hip belt, as a peplum or a peplum dress, as a head covering scarf combination, as a sarong, as a jacket and as a wrap.

Folded in half, the accessory becomes a ruffled belt which may be tied either at the front, side or back of the user. FIG. 3 illustrates use of the accessory as a belt worn at the waist.

Figure 4:
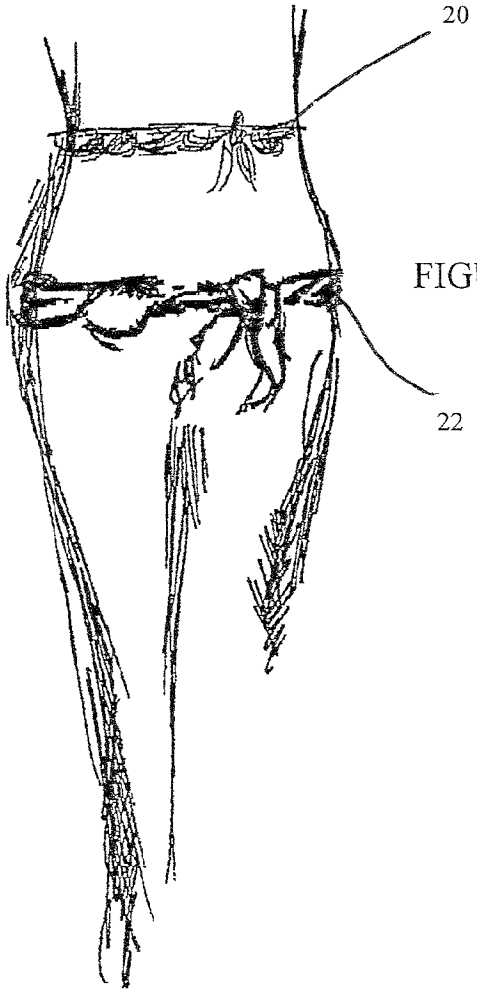

FIG. 4 illustrates use of the accessory as another form of waist belt 20 or as a hip belt 22.

Figure 5:
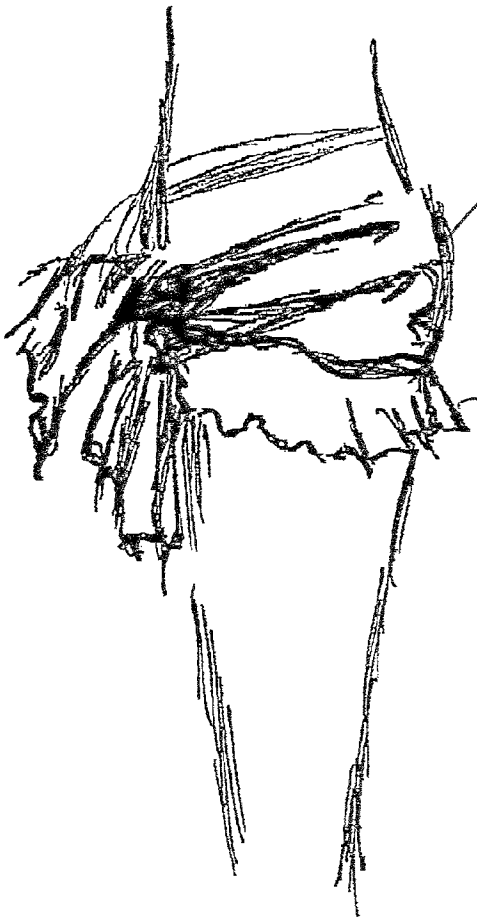
Figure 6:
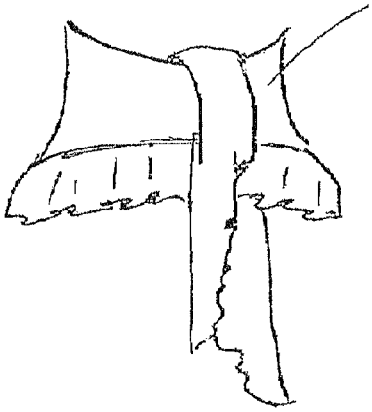
Figure 7:
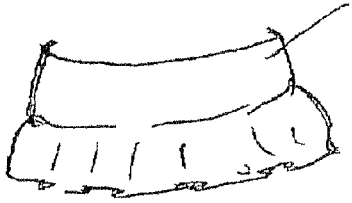

FIG. 5 shows use of the accessory as another form of hip belt 24, or folded in half, the accessory becomes a peplum or a peplum dress 26. FIGS. 6 and 7 show other uses of the accessory as a peplum or a peplum dress.

Figure 8:
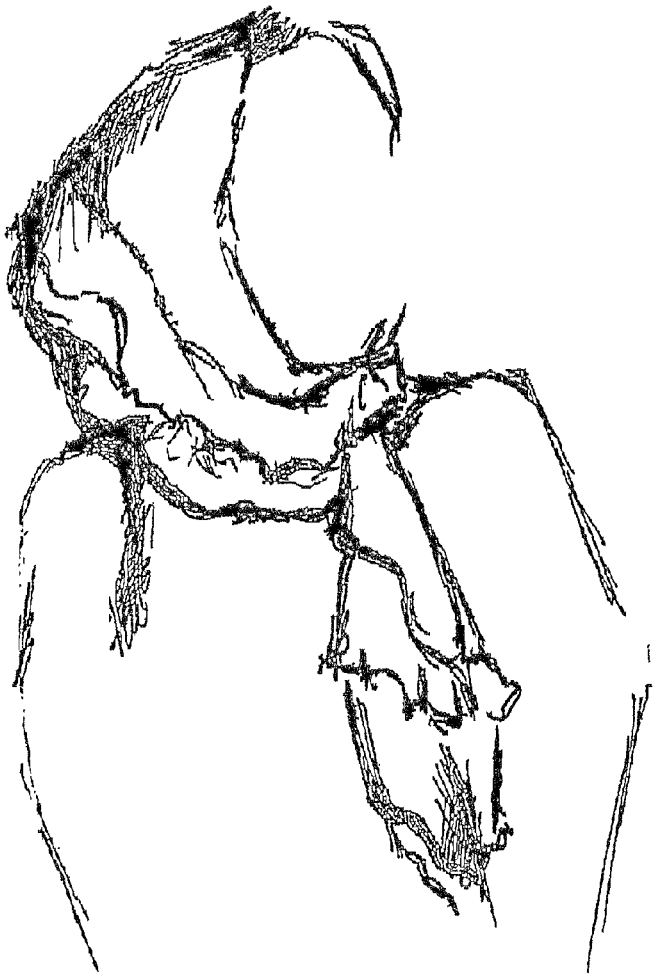

Folded in a variety of other ways, the accessory becomes a neck scarf, or a collar. FIG. 8 shows use of the accessory as a head covering scarf.

Figure 10:
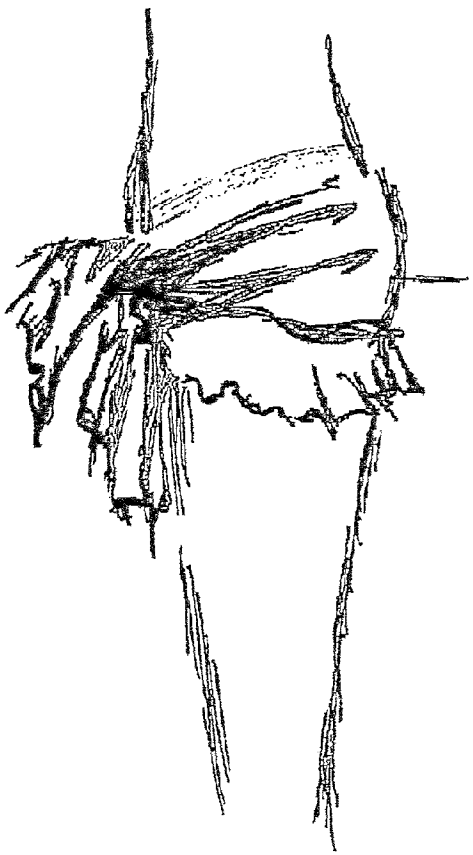
Figure 9:
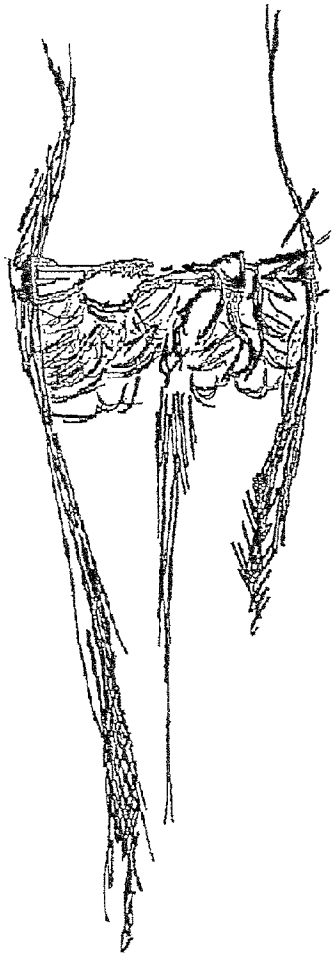
Figure 11:
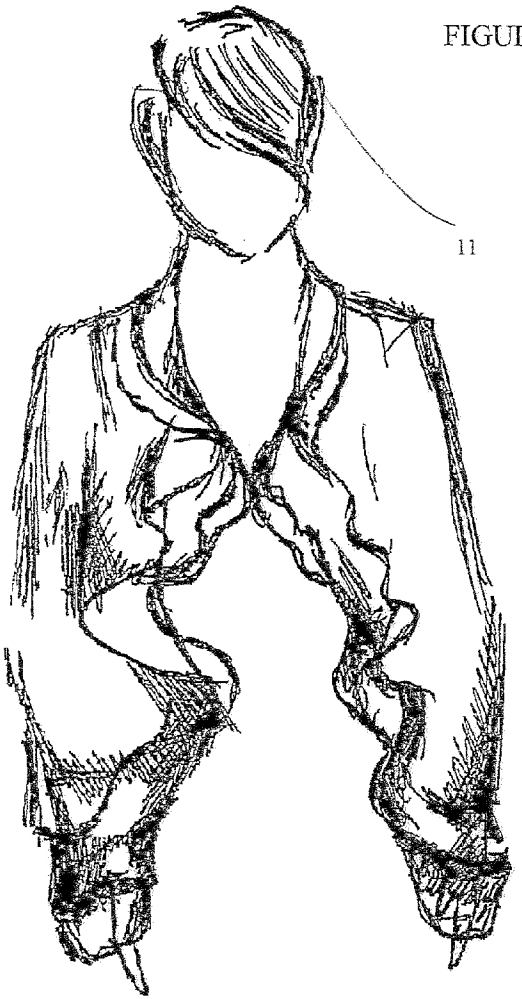

FIGS. 9 and 10 show use of the accessory as a sarong, which may be made longer or shorter by folding the accessory in the middle or only one-third of the way from the middle;

Used unfolded, the accessory may be used as a jacket. FIG. 11 shows use of the accessory as a jacket in which the wearer places her hands through the wristlets.

Figure 12:
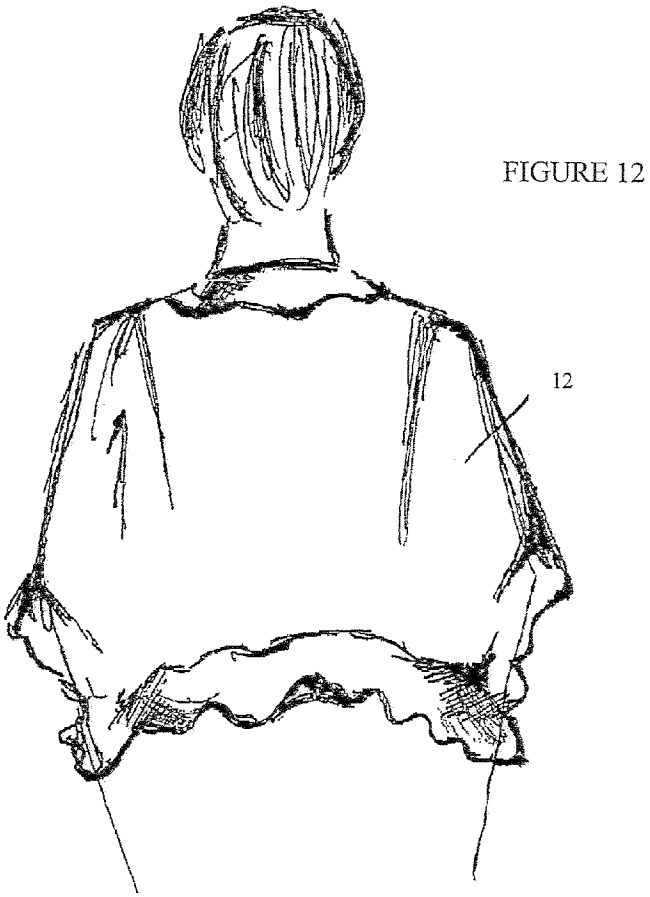

Alternatively, used unfolded, the accessory may be used as a wrap. FIG. 12 shows use of the accessory as a wrap.

It is thus seen there is provided a novel and useful multi-use clothing accessory. The accessory can be used as a neck scarf and tied in multiple ways. The accessory also may be used as a peplum or a peplum dress either as is or folded. The accessory also may be used as a waist belt or a hip belt. The accessory also may be used as a head covering or as a sarong or as a jacket or as a shawl.

Various changes may be made in the foregoing invention without departing from the spirit and scope thereof.

The invention claimed is:

1. A method of using a transformable clothing accessory comprising:

providing an elongated generally oval-shaped panel having a length defined laterally from left end to right end, the oval-shaped panel having an outer surface and an interior surface adapted to cover a human body of a wearer; the oval-shaped panel being constructed of a fabric material and having a peripheral edge; the oval-shape panel including a centerline extending between the left and right lateral ends; a ruffled fabric panel being affixed to the peripheral edge of the oval-shaped panel, the ruffled fabric panel having an outer surface; and an interior surface adapted to cover the human body of the wearer, the ruffled fabric panel having a perimeter free edge; and the left and right lateral ends of the oval-shaped panel each having a wristlet formed from a portion of the oval-shaped panel, the wristlet configured to receive a hand of the wearer therein, a perimeter of wristlet being defined by a portion of the ruffled fabric panel extending to the perimeter free edge of the ruffled fabric panel;

the method of using the transformable clothing accessory including a first transforming step, a second transforming step and a third transforming step;

the first transforming step including folding the oval-shaped panel lengthwise along the centerline to bring the interior surface together, placing the folded oval shaped panel around a torso of a wearer to transform the clothing accessory into a ruffled peplum or a ruffled peplum dress;

the second transforming step including placing the oval-shaped panel over a back, shoulders, upper torso and around the neck of the wearer such that the hands of the wearer extend through the wristlets to transform the clothing accessory into a ruffled jacket; and the third transforming step including folding the oval-shaped panel lengthwise along the centerline to bring the interior surface together, placing the folded oval shaped panel on a head of the wearer thereby transforming the clothing accessory into a ruffled head-scarf.

2. The method of using transformable clothing accessory according to claim 1, further comprising a fourth transforming step including folding the oval-shaped panel lengthwise along the centerline to bring the interior surface together, placing the folded oval shaped panel around a neck of the wearer, thereby transforming the clothing accessory into a ruffled neck scarf.

3. The method of using transformable clothing accessory according to claim 1, further comprising a fourth transforming step including folding the oval-shaped panel lengthwise along the centerline to bring the interior surface together, tying the folded oval shaped panel around a torso of the wearer, thereby transforming the clothing accessory into a ruffled waist belt or ruffled hip belt.

4. The method of using a transformable clothing accessory of claim 1, further comprising a fourth transforming step including placing the oval-shaped panel over a back, shoulders, upper torso and around the neck of the wearer, thereby transforming the clothing accessory into a ruffled edge shawl or stole.

5. The method of using a transformable clothing accessory of claim 1, further comprising a fourth transforming step including placing the oval-shaped panel around the waist of the wearer, thereby transforming the clothing accessory into a sarong.

6. The method of using a transformable clothing accessory of claim 1, wherein the step of providing further comprises the oval-shaped panel having a length-to-width aspect ratio of about 2.0 to 4.0.

7. The method of using a transformable clothing accessory of claim 1, wherein the step of providing further comprises the oval-shaped panel having a length-to-width aspect ratio of about 2.2 to 3.6.

8. The method of using a transformable clothing accessory of claim 1, wherein the step of providing further comprises the oval-shaped panel having an overall length of about 58 inches from the left end to the right end.

9. The method of using a transformable clothing accessory of claim 1, wherein the step of providing further comprises the oval-shaped panel having an overall length of about 62 inches from the left end to the right end.

10. The method of using a transformable clothing accessory of claim 1, wherein the step of providing further comprises the oval-shaped panel comprising a single piece of fabric.

11. The method of using a transformable clothing accessory of claim 1, wherein the step of providing further comprises the ruffled fabric panel being stitched to the oval-shaped panel.

12. The method of using a transformable clothing accessory of claim 1, wherein the step of providing further comprises the ruffled fabric panel being adhesively fixed to the oval-shaped panel.

13. The method of using a transformable clothing accessory of claim 1, wherein the step of providing further comprises the lateral ends of the oval-shaped panel being fixed together by stitching.

* * * * *